United States Patent [19]

Bell

[11] Patent Number: 4,738,385

[45] Date of Patent: Apr. 19, 1988

[54] DISPENSING APPARATUS

[75] Inventor: Randall Bell, Oak Park, Ill.

[73] Assignee: Wilton Enterprises, Inc., Woodridge, Ill.

[21] Appl. No.: 924,366

[22] Filed: Oct. 29, 1986

[51] Int. Cl.[4] ..... A47K 10/36; B26F 3/02; B65D 85/672

[52] U.S. Cl. ..... 225/106; 225/79; 225/87; 242/55.54; 242/156

[58] Field of Search ..... 225/106, 87, 79, 51; 242/55.54, 156, 156.1

[56] References Cited

U.S. PATENT DOCUMENTS 4,369,929 1/1983 Cayer ..... 242/55.54 X 4,487,376 12/1984 Compton ..... 225/79 X 4,690,345 9/1987 Cotey ..... 242/55.54 X

*Primary Examiner*—Frank T. Yost

*Attorney, Agent, or Firm*—Robert E. Wagner; Ralph R. Rath

[57] ABSTRACT

A dispensing device includes a base having an upstanding post with a gripping means on the upper end biased to a first position and movable to a second position. The hollow post telescopingly receives a roll of articles separated into individual segments and the gripping means can be pushed from the first positon to frictionally grip the roll between the base and the gripping means so that the article can easily be separated from the roll without any rotation of the roll.

12 Claims, 2 Drawing Sheets

DISPENSING APPARATUS

DESCRIPTION

1. Technical Field

The present invention relates generally to sheet material dispensers for dispensing individual articles from a continous supply and, more particularly, to dispensing of individual articles from a roll, such as paper towels.

2. Description of the Prior Art

Various household products are supplied in a continuous roll wherein a predetermined amount of the roll can be removed for its intended use. An example of such rolls of product are paper towels or toilet tissue, which are usually supplied in a large roll and individual sheets are defined in the roll by a serrated line.

The most common type of holder for paper towels consists of a generally U-shaped holder that has a base which is secured to a supporting structure and two outwardly-directed legs extending from the base. The outwardly-directed legs have aligned openings which receive a tubular support member, such as a rod, which is also received through the hollow core of the roll. Thus, individual sheets of articles can be removed by gripping the free end portion of the roll with one hand and rolling the desired number of sheets to be removed to a point where a serrated line is exposed and a second hand is utilized to grip the roll adjacent the serrated line so that the selected sheets can be removed from the roll. Many times this type of holder is secured in a remote location, such as the inside surface of a cabinet door or under the lower surface of a cabinet conventionally found in most household kitchens. Thus, it becomes very difficult to separate the desired sheets along the serrated lines.

Another type of dispensing apparatus, particularly for paper towels and the like, consists of a base member that has an upstanding upwardly-directed center post which is telescopingly-received into the hollow core, normally found in rolls of this type. Again, this type of dispensing apparatus has the shortcoming in that it is difficult to separate the individual sheets along the serrated lines.

SUMMARY OF THE INVENTION

According to the present invention, a dispensing apparatus has been developed which can hold a roll of a plurality of articles interconnected by serrated lines so that the articles can be easily and efficiently separated along the serrated lines.

More particularly, the dispensing device of the present invention consists of a base having an upstanding post which receives a roll having a hollow core with a gripping means on the upper end of the post normally biased to a position spaced from an upper edge of the roll. The biasing means is designed to accommodate movement of the gripping means towards the base to grip and hold the roll in a predetermined position so that an article can readily be separated from the roll. In the illustrated embodiment, the individual articles are sheets of disposable towels which form the roll and individual sheets are separated by serrated lines or perforations.

More specifically, the dispensing unit consists of a circular base that has a circular opening at the center thereof with the post having a reduced diameter portion at its lower end frictionally gripped in the opening. The upper end of the post has a reduced diameter portion defining an internal shoulder and a plunger is slidably received into the reduced diameter portion and has an outwardly-directed shoulder adjacent its lower end to abut with the shoulder on the post. A spring is located in the hollow post, which has a divider or wall means spaced from the top and the spring engages the divider and the lower surface of the plunger to bias the plunger outwardly and produce engagement between the shoulders.

The gripping means is in the form of a hub or hollow circular member that has a socket depending therefrom which receives and frictionally grips the upper end of the plunger so that the member can easily be removed for replacement of the used roll of articles.

The base may also have an upwardlyextending abutment adjacent the periphery thereof which is alignable with the serrated line to aid in initiating the tearing action along the serrated line.

According to one aspect of the invention, the center upstanding post is hollow and formed in substantially two semi-circular halves with interconnecting means in the form of a slot or slots on one of the halves and projections on the other of the halves so that the two halves can readily be interconnected by producing radial forces thereon. Thus, the coil spring and the plunger can easily be assembled into the hollow post.

BRIEF DESCRIPTION OF SEVERAL VIEWS OF DRAWINGS

FIG. 1 of the drawings is a perspective view of the dispensing apparatus constructed in accordance with the present invention and having a roll, such as a roll of paper towels, supported thereon;

DETAILED DESCRIPTION

Figure 1:
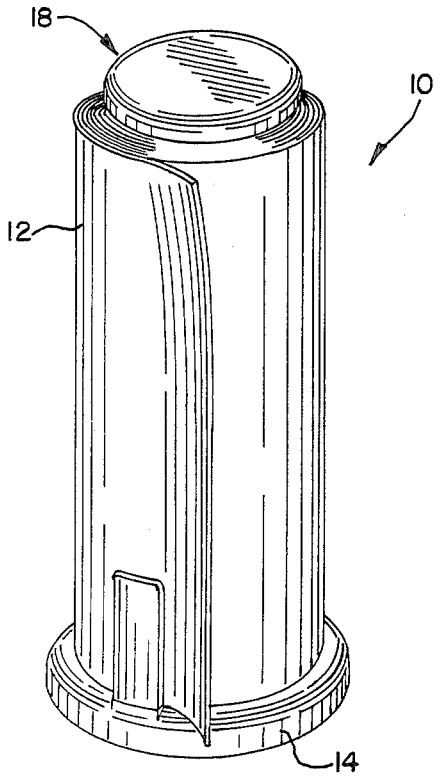

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 of the drawings discloses a dispensing apparatus, generally designated by reference numeral 10, having a roll of articles, such as paper towels 12, supported thereon. The dispensing apparatus is illustrated in exploded view in FIG. 2 and consists of a base 14, a center post 16 extending above the base, and a gripping means 18 carried on the upper end of the post.

The base 14 consists of a circular member that has a central opening 20 that has ribs 22 formed on the wall thereof to define frictional gripping means. The post 16 consists of two molded halves 24 and 26 which are hollow and semi-circular. One of the halves 24 has a plurality of spaced projections 28 extending from opposite edges thereof, while the other half has a plurality of spaced openings 30 along opposite edges thereof for receiving the projections to interlock the two halves to each other. In the assembled condition, the two halves define a lower reduced diameter portion 32 that is received into the opening of the base and is frictionally gripped therein by the ribs 22.

The upper end of the post 16 has a reduced diameter portion 40 which has an opening 44 that slidably supports a plunger 46. The reduced diameter portion 40 defines a shoulder 48 at the upper end of the post and the plunger 46 has an outwardly-directed flange 50 intermediate opposite ends that is biased toward the shoulder 48 by means which will be described later. The lower end of the plunger 46 also has a second enlarged flange 52 formed thereon which is slidably supported on the inner wall of the post or hollow tube 16.

Figure 4:
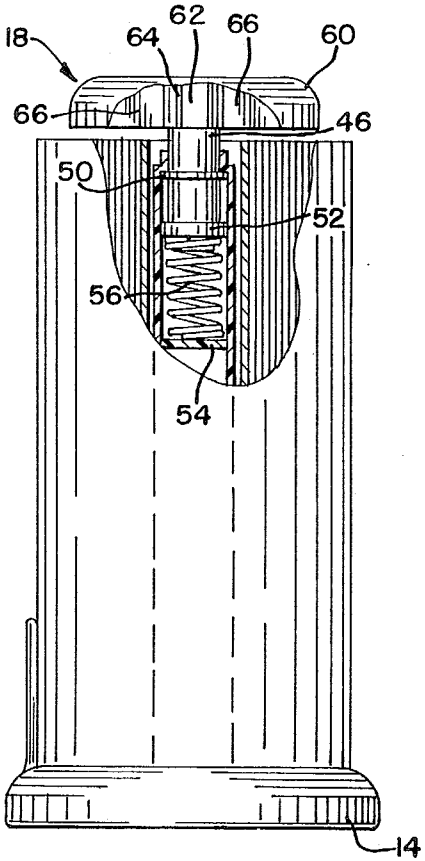

The two post halves 24 and 26 also have a wall means or divider means 54 spaced from the shoulder 48 and a spring or biasing means 56 is interposed between the wall means and the lower end of the plunger 46 to bias the plunger to an upper-most position wherein the abutment 50 engages the shoulder 48, as illustrated in FIG. 4.

In the illustrated embodiment, there are two fins illustrated which are diametrically aligned with each other, but more than two circumferentially-spaced radial fins could be provided.

As illustrated in FIG. 4, the gripping means 18 consists of a hollow circular member or cup 60 that has a central socket 62 that is telescopingly received onto the upper end of the plunger 46 and the hub is slotted at 64 so as to frictionally grip the end of the plunger 46. The hollow circular member has one or more radial fins 66 extending between the outer wall and the center socket, for a purpose to be described later.

Figure 2:
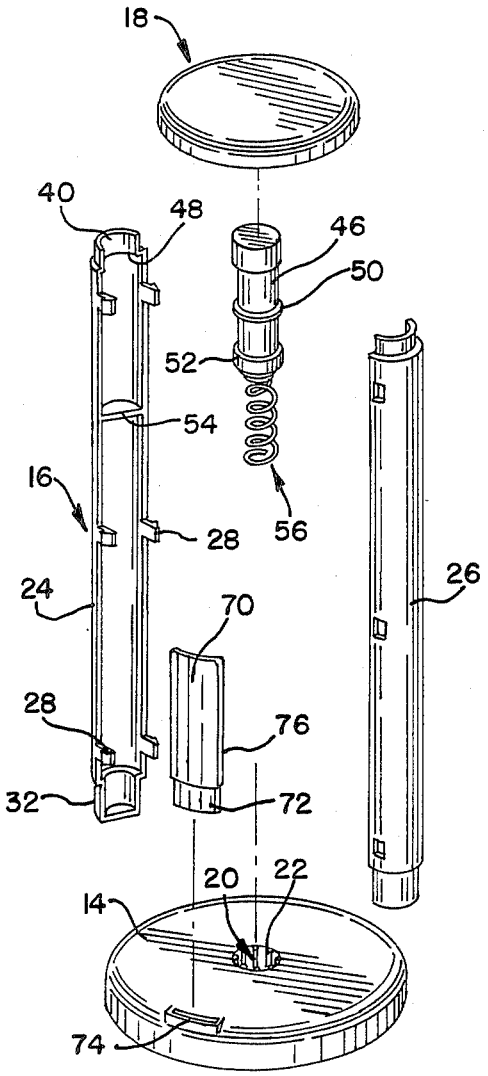
FIG. 2 is an exploded perspective view of the dispensing apparatus.
Figure 3:
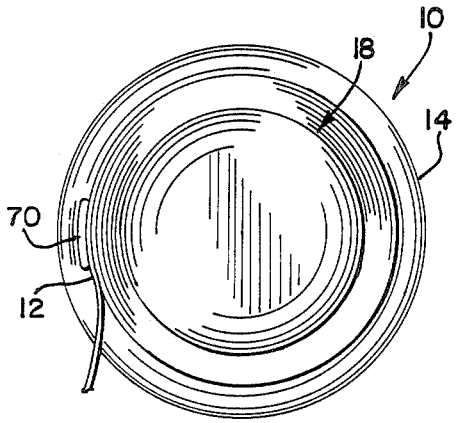
FIG. 3 is a top view of the apparatus disclosed in FIG. 1.

The dispensing device also has an abutment means carried by the base for use in alignment with the perforated line to initiate the tearing action along the perforated line. As illustrated in FIG. 2, the abutment consists of an upstanding arcuate projection 70 that has a lower arcuate reduced portion 72 received into an arcuate opening 74 defined on the periphery of the base 14. The arcuate abutment 70 has opposed lateral edges 76 that define tearing edges, as will be described later.

It is believed that the assembly and operation of the device is readily apparent from the above description, but will be repeated for purpose of completeness.

Initially, the two molded halves 24 and 26 are molded from a plastic material to the configuration shown in FIG. 2. A one-piece molded plunger and the spring are then inserted into the proper position, shown in FIG. 4. The two molded halves 24, 26 are then assembled by forcing the projections into the openings so that a circular tubular post is formed with the plunger supported in the upper end of the post, while the lower end has a reduced portion 32 which is received into the opening 20. The biasing spring 56 biases the plunger upwardly so that the shoulder or abutment 50 engages the shoulder 48 defined on the tube or post. The gripping member 18 is then inserted onto the upper end of the plunger 46, which is received into the socket 62 and is frictionally retained therein. The abutment 70 is then inserted into the slot 74 and the dispensing unit is ready for operation.

To initially insert a roll 12 of a product, such as paper towels, the gripping member 18 is removed and the hollow core of the roll 12 is telescoped over the post 16. The gripping member 18 is then reinserted onto the upper end of the plunger 46 and is in the condition shown in FIG. 1. In this position, the biasing spring 56 (FIG. 4) biases the plunger 46 and the associated gripping member 18 upwardly to a position spaced from the upper edge of the roll 12.

Figure 5:
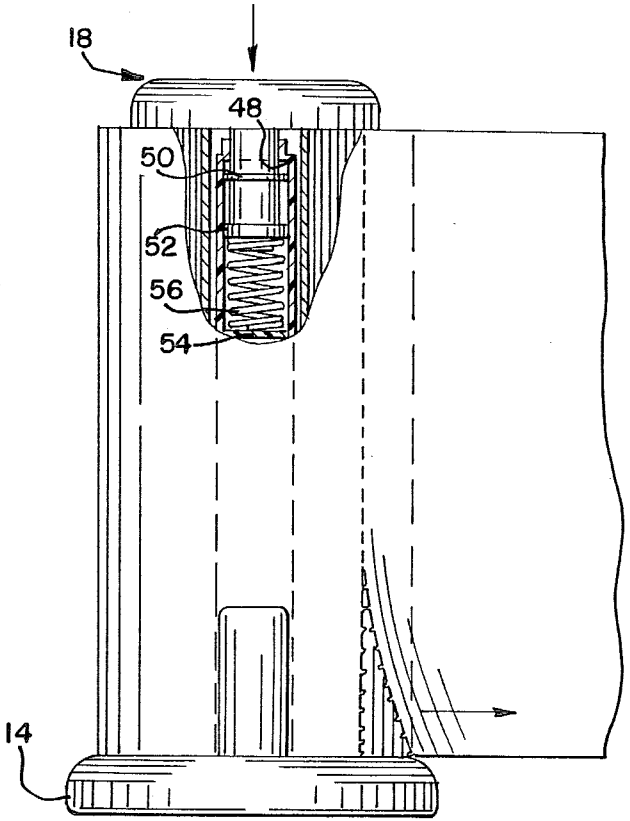
FIGS. 4 and 5 are side elevation views with parts thereof broken away for purposes of clarity.

When it is desired to remove a selected segment of the roll, the free end of the roll is gripped and is pulled, thereby rotating the roll 12 on the post 16, until a perforated line (not shown) is aligned with one of the edges 76 of the abutment, dependent upon the position of the roll on the post. The gripping means 18 is then depressed from the position shown in FIG. 4 to that shown in FIG. 5, wherein the roll of articles, such as paper towels, is frictionally gripped between the base 14 and the gripping means 18, more specifically fins 66. This will prevent any further rotation of the roll on the post 16. A lower edge of the article being severed is then gripped and pulled upwardly so that the perforated line is severed along the edge 76 and this continues to separate the desired segment of the roll from the remainder.

It will be appreciated that the present invention provides an extremely simplified, inexpensive dispensing unit in which all of the parts, with the exception of a conventional spring, can be molded into various pieces and can be assembled without the use of any special tools.

Of course, various modifications come to mind without departing from the spirit of the invention. For example, the annular flange or abutment 50 could be eliminated and the flange or shoulder 52 at the lower end of the plunger could be utilized as the abutment and the axial orientation could be maintained by extending the length of the reduced portion or sleeve 40. Also, if desired, the shoulder 48 could be defined at a point below the reduced diameter portion 42 and the unit would still operate in the same desired manner.

In addition, the gripping means 18 could take various different configurations so long as the gripping means has some means for engaging the upper edge of the roll, even when the roll is almost depleted. The two halves that define the post 16 could also have projections along one edge and slots on an opposite edge so that one molded piece could be used for both halves. Alternately, the post could be formed from more than two segments.

While specific embodiments have been illustrated and described, numerous modifications come to mind without significantly departing from the spirit of the invention and the scope of protection is only limited by the scope of the accompanying claims.

I claim:

1. A dispensing device for dispensing paper articles from a roll of said articles comprising a base having an upstanding post with said roll having a hollow core received over said post, gripping means on the upper end of said post extending across at least a portion of an upper edge of said roll, biasing means between said post and said gripping means for normally maintaining said gripping means spaced from said upper edge so that said roll is freely rotatable on said post, said biasing means accommodating movement of said gripping means toward said base to grip and hold said roll in a predetermined position between said gripping means and said base so that an article can readily be severed from said roll.

2. A dispensing device as defined in claim 1, in which individual articles in said roll are defined by a perforated line and in which said base has an upstanding abutment adjacent a periphery thereof alignable with a perforated line so that said abutment will aid in initiating tearing of said article from said roll.

3. A dispensing device as defined in claim 1, in which said base is a substantially circular member having a circular opening at its center and said post is circular and has a reduced diameter portion at its lowered end received into said circular opening with friction gripping means between said base and said reduced diameter portion on said base.

4. A dispensing device as defined in claim 1, in which said circular post is hollow and is formed of two substantially identical halves with latch means between said halves for interconnection to each other.

5. A dispensing device as defined in claim 4, in which said substantially identical halves are hollow semi-circular members having a wall means spaced from an upper end and an inwardly-directed shoulder adjacent said upper end with an opening therein and in which said gripping means includes a plunger extending through said opening and having an outwardly-directed abutment adapted to engage said shoulder.

6. A dispensing device as defined in claim 5, in which said biasing means includes a coil spring in said post positioned between said wall means and a lower end of said member on said gripping means.

7. A dispensing device as defined in claim 5, in which said plunger is slidably supported in said post and said gripping means has an opening receiving an upper end of said plunger and being frictionally gripped therein.

8. A dispensing device as defined in claim 7, in which said gripping means includes a hollow circular member having at least one fin for engaging said upper edge of said roll.

9. A dispensing device as defined in claim 8, in which said hollow circular member has a center socket defining said opening for receiving said plunger.

10. A dispensing apparatus for dispensing selected segments of a roll comprising a base having a central opening and a post having a lower end received into said central opening, said post including a plurality of hollow segments with one segment having projections adjacent an edge while an adjacent segment has slots on an adjacent edge for receiving said projections to assemble the segments to form said post, said post having a reduced diameter portion at its upper end with a plunger slidably supported therein, biasing means in said post biasing said plunger to an outwardly-extended position, and gripping means received onto a free end of said plunger, said gripping means and plunger being movable from said extended position to grip the roll between said base and said gripping means to prevent rotation thereon and allow selected segments of said roll to be severed.

11. A dispensing apparatus as defined in claim 10, in which said post includes two semi-circular hollow segments with projections on opposite edges of one segment and the other segment having slots on opposite edges receiving said projections.

12. A dispensing apparatus as defined in claim 10, further including abutment means extending above a peripheral portion of said base defining a tearing edge.

* * * * *